US006595508B2

(12) United States Patent
Duncan

(10) Patent No.: US 6,595,508 B2
(45) Date of Patent: Jul. 22, 2003

(54) VISE WITH JAW CONTROL

(75) Inventor: John S. Duncan, Independence, KY (US)

(73) Assignee: Duncan & Associates, Cincinnati, OH (US)

( * ) Notice: Subject to any disclaimer, the term of this patent is extended or adjusted under 35 U.S.C. 154(b) by 12 days.

(21) Appl. No.: 09/878,795

(22) Filed: Jun. 11, 2001

(65) Prior Publication Data

US 2002/0185800 A1 Dec. 12, 2002

(51) Int. Cl.[7] ..... B25B 1/10
(52) U.S. Cl. ..... 269/242; 269/43
(58) Field of Search ..... 269/242, 241, 269/195, 329, 244, 243, 43, 268, 247; 279/112

(56) References Cited

U.S. PATENT DOCUMENTS

| | | | | |
|---|---|---|---|---|
| 1,246,961 A | * | 11/1917 | Long | 269/242 |
| 3,490,547 A | | 1/1970 | Stewart | |
| 3,675,916 A | * | 7/1972 | Kartasuk et al. | 269/69 |
| 3,833,068 A | * | 9/1974 | Hall | 173/169 |
| 4,040,613 A | | 8/1977 | Kartasuk et al. | |
| 4,046,364 A | * | 9/1977 | Coope et al. | 269/244 |
| 4,192,521 A | * | 3/1980 | Smith | 279/112 |
| 4,205,833 A | | 6/1980 | Lenz | |
| 4,243,213 A | | 1/1981 | Georgian | |
| 4,593,892 A | | 6/1986 | Terstegge | |
| 4,760,999 A | * | 8/1988 | Yang | 269/241 |
| 4,901,418 A | | 2/1990 | Machado et al. | |
| 4,971,301 A | * | 11/1990 | Yang | 269/247 |
| 5,141,213 A | | 8/1992 | Chern | |
| 5,273,264 A | | 12/1993 | Chen | |
| 5,683,077 A | | 11/1997 | Fink et al. | |
| 5,876,526 A | * | 3/1999 | Hamade et al. | 152/416 |
| 6,062,323 A | * | 5/2000 | Pusateri et al. | 173/169 |
| 6,206,354 B1 | | 3/2001 | Lin | |

FOREIGN PATENT DOCUMENTS

| | | |
|---|---|---|
| DE | 29 12 165 | 10/1980 |
| EP | 0 742 081 | 5/1996 |

* cited by examiner

*Primary Examiner*—Lee D. Wilson
(74) *Attorney, Agent, or Firm*—Wood, Herron & Evans LLP

(57) ABSTRACT

A vise (10) having a control aperture (74) at an accessible end (54) of a screw rod (50) and extending along the rotational axis (52) thereof. The aperture (74) is sized and shaped to accept the anvil (72) of a drive mechanism (70) so that upon rotation of the anvil (72) along its torque axis (80), screw rod (50) rotates about its rotational axis (52). At least one of a pair of jaws (18, 20) is operatively associated with screw rod (50) to thereby vary the spacing (34) therebetween as screw rod (50) rotates under control of the anvil (72).

18 Claims, 4 Drawing Sheets

VISE WITH JAW CONTROL

BACKGROUND OF THE INVENTION

I. Field of the Invention

The present invention relates to vises, and more particularly, to vises where rotating a screw rod causes relative movement of a pair of jaws to engage a workpiece therebetween.

II. Description of Prior Art

Vises are well known in the prior art and are useful for clamping and holding workpieces. A typical vise has a pair of jaws which are moveable relative to one another by means of a screw rod operably associated with one or both of the jaws, whereby a workpiece may be clamped between the jaws by rotating the screw rod along its rotational axis. Many vises are also provided with a base useful for independently and stably supporting the vise on a flat work surface. The base may include one or more flanges with holes for securely bolting the vise to the work surface, or the base may be secured to a work surface by other means such as clamping, suction, or magnetic force.

To control the spacing of the jaws, a handle is provided at an accessible end of the screw rod. To this end, a large hub at the accessible end of the screw rod supports the handle in a hole extending through the hub orthogonal to the rotational axis of the screw rod such that the handle extends orthogonally relative to the screw rod axis. The handle is generally slidably retained within the hole in the hub and is used for turning the screw rod to thereby move the jaws to clamp or release an object placed between the jaws. The handle generally has permanently formed ends which permit sliding of the handle substantially along its entire length within the hole, while preventing the handle from sliding out of the hole. Because the handle must be rotated to operate the vise, operators may injure their knuckles against either a work surface or a workpiece mounted in the vise while turning the handle. Operators may also pinch their fingers between the formed ends of the handle and the hub as the handle slides down during rotation of the handle.

Vises with bases designed to be set on or clamped to a flat work surface present additional drawbacks. For example, the handle limits freedom of location of the vise. More particularly, to effectively utilize the handle, the base must typically be mounted near an edge of the work surface with a portion of the vise, and particularly the handle, extending beyond the edge so that the handle may be freely rotated without impacting against the work surface. The overhanging portion of the vise and the handle also present safety issues. Persons moving about the work area often run into the protruding portion of the vise or the handle. The overhanging portion of the vise and handle can also present obstruction and safety concerns for dollies or fork lifts that may be required to navigate in or through the work area. Similar problems are created in mounting vises to work vehicles, such as trucks or the like.

Prior art vises also suffer from difficulties in sufficiently clamping a workpiece using the handle. To gain additional leverage with respect to the handle in order to sufficiently clamp a workpiece, many times an extension, such as a length of pipe, is fitted over the handle. Some have also used hammers to impact the handle or the extension placed over the handle, in an attempt to improve clamping against a workpiece positioned in the jaws. Use of extensions and hammers in this manner present further safety issues, and may damage the workpiece or the vise. Finally, conventional vises are slow and cumbersome to control using the handle when the jaws of the vise must be moved towards (e.g. to close) or away from (e.g. to open) each other over more than a short distance, or when they must be repeatedly opened and closed about one or more workpieces.

SUMMARY OF THE INVENTION

The present invention provides jaw control which reduces or eliminates the problems associated with conventional vises which provide control by a handle orthogonally and slidably received in the hub. To this end, and in accordance with the principles of the present invention, an aperture sized and shaped to receive the anvil of a drive mechanism is provided at the accessible end of the screw rod extending along the rotational axis of the screw rod. The drive mechanism anvil projects from a torque driver and is rotatable thereby. When the anvil is inserted into the aperture along the screw rod rotational axis, that axis and a torque axis of the drive mechanism are substantially aligned such that rotation of the anvil about the torque axis causes the screw rod to rotate thereby moving the jaws relative to one another. The aperture is advantageously shaped and sized to receive the anvil of a standard drive mechanism, such as a pneumatic impact wrench, an electrically powered screw driver-like device, or a ratchet wrench.

By coupling the screw rod to a drive mechanism along the rotational axis, such as via the aperture and the anvil, the orthogonal handle may be dispensed with. The vise may thus be utilized with driving mechanisms that reduce or eliminate the tendency to impact against work surfaces or body parts. Further, the aperture is readily accessible to the anvil even when the vise is mounted on a work surface well away from any edge thereof, thus allowing for control of the vise jaws without the drawbacks of vise parts overhanging the work surface or jutting out therefrom. Additionally, the drive mechanism allows for quick rotation of the screw rod, and readily achieves multiple, repeated openings and closings with ease. The drive mechanism may also impart substantial torque to the screw rod via the anvil and aperture such that a workpiece may be tightly gripped without the need to resort to extensions or hammers to achieve extra leverage, either to open or close the jaws.

The aperture may be provided directly in the accessible end of the screw rod, either by forming same in, or integrally attaching a hub with the aperture formed therein to, the accessible end of the screw rod. Alternatively, the aperture may be supported on a fitting which can be removably coupled to the accessible end of the screw rod.

There may be some situations where the operator may wish to have manual control over the vise jaws, such as was provided by the conventional handle. By way of example, use of a drive mechanism with its rotatable anvil may not be desired when working with delicate workpieces or for fine adjusting control. To this end, and in accordance with a further aspect of the present invention, a handle may also be associated with the accessible end of the screw rod and extending orthogonal to the rotational axis thereof so as to provide movement control by use of the handle in a more or less conventional manner. The handle may be rigidly secured to the accessible end of the screw rod or to the fitting. Where the handle is rigidly secured, its length is advantageously less than the distance between the screw rod rotational axis and the bottom of the base so as not to impact the work surface as it rotates.

Alternatively, a handle-receiving hole may be provided at the accessible end of the screw rod, either directly or via the fitting, which hole extends orthogonally to the screw rod rotational axis. The handle may be received in the hole, and may advantageously be removably received therein. When the handle is removably received, the handle may be long to provide the traditional handle function, but may be removed as desired or necessary. To this end, the handle may include a protrusion sized to retain the handle in the hole in the hub while the handle is being used to manually rotate the screw rod. The protrusion may include a spring loaded member which may move out of the way as the handle is inserted into or removed from the holes. The protrusion may be at the end of, or centrally located on, the handle. The protrusion may further be selectively removable from the handle to facilitate removal of the handle from the hole.

By virtue of the foregoing, there is thus provided a jaw control for a vise which reduces or eliminates the problems associated with conventional vises which provide jaw control by a handle slidably received in the hub. These and other objects and advantages of the present invention shall be made apparent from the accompanying drawings and description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE DRAWINGS

Figure 1:
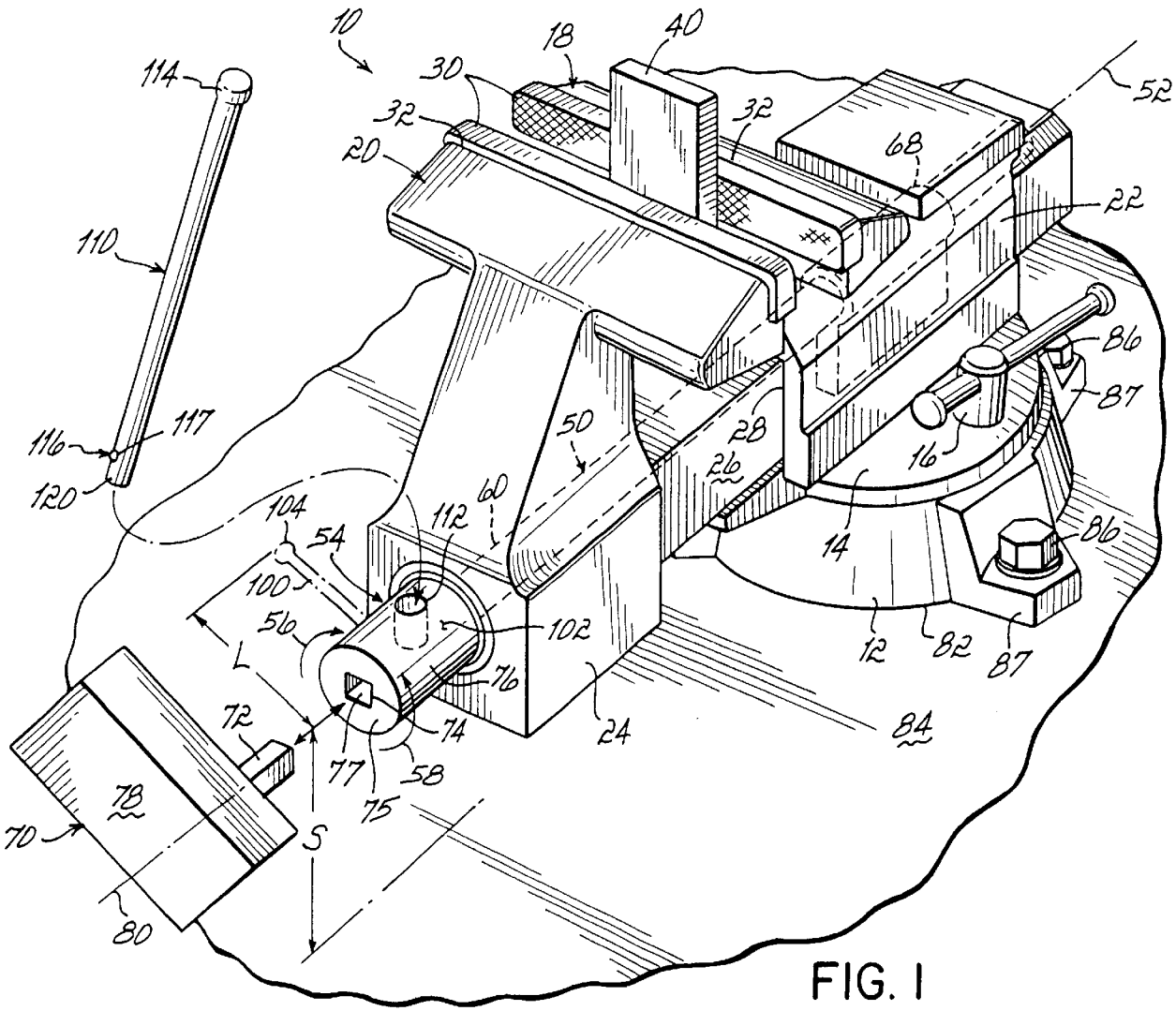
FIG. 1 is a perspective view of a first exemplary vise on a flat work surface and a drive mechanism to cooperate with a jaw control aperture of the vise in accordance with the principles of the present invention.
Figure 1A:
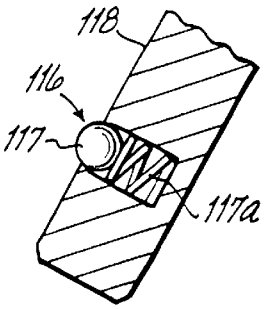
FIG. 1A is an enlarged view of the protrusion on a handle of FIG. 1.
Figure 2:
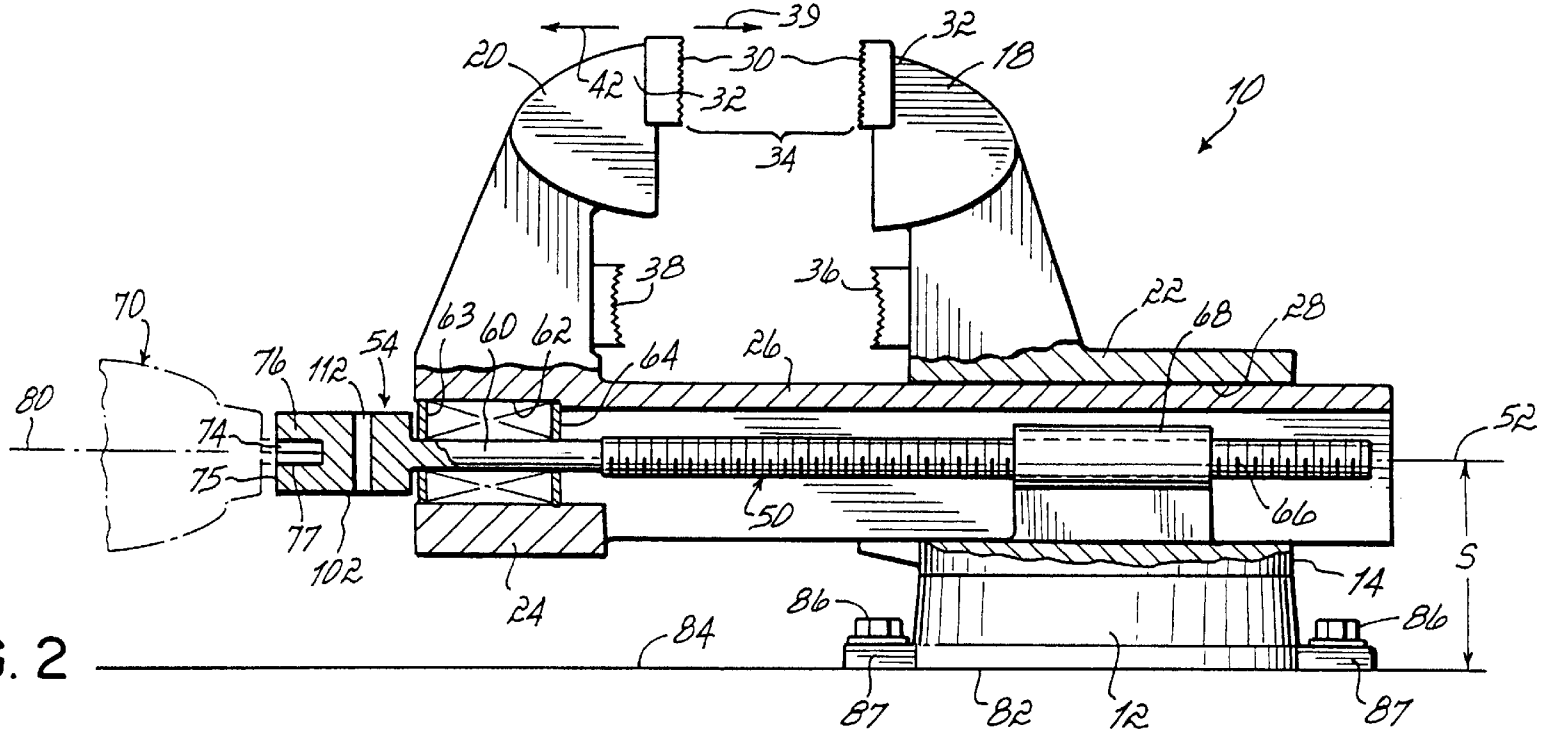
FIG. 2 is a cross-sectional view of the vise of FIG. 1 on the work surface.

With reference to FIGS. 1 and 2, there is shown an exemplary general purpose vise 10 incorporating features of the present invention as will be hereinafter described. Vise 10 includes a base 12 to which is selectively rotatably mounted support 14. Support 14 includes lock twist 16 which in a first position locks support 14 to base 12, and in a second position releases support 14 to rotate about an axis (not shown) relative to base 12 as is conventional. Vise 10 includes a pair of jaws 18, 20 supported on base 12 so as to be movable relative to one another. To this end, first jaw 18 is integrally attached via jaw foot 22 to support 14 and so does not move relative to support 14 (or base 12 when support 14 is locked in the first position). Second jaw 20 includes jaw foot 24 and projecting leg 26 by which to movably attach jaw 20 to support 14. To this end, inverted U-shaped leg 26 is telescopically receivable through slot 28 of jaw foot 22 so as to guide jaw 20 as it moves relative to jaw 18. Jaws 18, 20 include confronting gripping pads 30 removably secured or integrally formed at the upper extent 32 to each of jaws 18 and 20 and defining a workpiece-holding space 34 between jaws 18, 20. The jaws 18, 20 may further include complementary gripping projections 36, 38 (FIG. 2) spaced below gripping pads 30.

As will be readily appreciated, as jaws 18 and 20 are moved relative one another in the direction of arrow 39, space 34 will narrow or close to grip a workpiece 40 (FIG. 1) between gripping pads 30 and/or gripping projections 36, 38. Jaws 18 and 20 may be moved relative to one another in the opposite direction (arrow 42) so as to increase space 34 such that pressure on workpiece 40 is released to thereby free workpiece 40 from vise 10.

To effectuate the relative movement of jaws 18, 20, and to thus vary spacing 34 therebetween, vise 10 is provided with a screw rod 50 which is operably associated with at least one of jaws 18, 20, such as moveable jaw 20. Screw rod 50 is an elongated member extending below jaws 18, 20 and rotatable about a rotational axis 52 which in the embodiment shown extends longitudinally of screw rod 50. Screw rod 50 has a proximal end 54 accessible outside of jaw foot 24. Screw rod 50 extends from accessible end 54 through jaw feet 22, 24 and within leg 26. Screw rod 50 is operatively associated with jaw 20 so as to cause jaw 20 to move toward (closing into) or away from (opening from) jaw 18 as screw rod 50 rotates about its rotational axis 52 either clockwise (as indicated by arrow 56) or counter-clockwise (as indicated by arrow 58), respectively.

In the vise 10 shown herein, screw rod 50 is operably associated with jaw 20 by rotatably gripping a portion 60 of screw rod 50 inboard of accessible end 54 within passage 62 of jaw foot 24 such as by thrust washers 63, 64. Screw rod 50 includes a screw thread 66 formed therealong which threadably interacts with an internally threaded cylinder 68 fixedly held to support 14 below or behind jaw 18 and within leg 26. Thus, as screw rod is rotated along its rotational axis 52, thread 66 thereof interacts with cylinder 68 to cause screw rod 50 to move longitudinally along rotational axis 52 relative to support 14 and/or base 12. As screw rod 50 moves, the accessible end 54 thereof moves towards or away from support 14 and/or base 12 carrying jaw 20 therewith towards and away from jaw 18 thereby varying spacing 34.

As will thus be appreciated, rotation of screw rod 50 determines the relative spacing 34 between jaws 18 and 20. In accordance with the principles of the present invention, rotation of the screw rod 50, and hence movement of jaws 18, 20, is accomplished by coupling a drive mechanism 70, and particularly, the anvil 72 thereof, to accessible end 54 of screw rod 50. To this end, a control aperture 74 is located at accessible end 54 by providing same directly in proximal end face 75 of hub 76 forming accessible end 54. Face 75 is generally orthogonal to rotational axis 52 such that accessible end 54 terminates at face 75. Also, hub 76 is bounded by peripheral surface 102 which is concentric with rotational axis 52. A plurality of interconnected, internal walls 77 extend from face 75 into accessible end 54 along rotational axis 52 so as to define a predetermined size and shape of aperture 74 spaced inwardly of peripheral surface 102. The size and shape is selected to matingly receive anvil 72 for rotation therewith.

Drive mechanism 70 includes a torque driver 78 from which anvil 72 rotatably projects for rotation about a torque axis 80. Anvil 72 has a predetermined size and shape to fit within aperture 74 of screw rod 50 and cause rod 50 to rotate about rotational axis 52 when anvil 72 is rotated about torque axis 80. To accomplish same, anvil 72 is inserted along rotational axis 52 into aperture 74 so as to align torque axis 80 and rotational axis 52 (see FIG. 2). Torque driver 78 rotates anvil 72 about torque axis 80 which, due to the mutual size and shape of aperture 74 and anvil 72, causes screw rod 50 to rotate about rotational axis 52. As a consequence, the spacing 34 between jaws 18 and 20 may be varied by use of the torque driver 78 of drive mechanism 70.

Base 12 may define a planar contact at its bottom side 82 so as to sit on flat work surface 84. Base 12 is sized so that vise 10 will normally sit independently and stably on surface 84 without tipping over, for example, when not in use. Bolts 86 may be utilized to secure base 12 to surface 84 via base flanges or legs 87 as is conventional.

In use, vise 10 is set down with base 12 independently and stably resting on surface 84 and may be attached well inboard of an edge (not shown) thereof. Vise 10 may be attached to a work vehicle (not shown) as desired. Drive mechanism 70 is coupled to face 75 of accessible end 54 by which to control rotation of screw rod 50 and thus spacing 34 of jaws 18, 20. To this end, anvil 72 is inserted into aperture 74 and torque driver 78 utilized to rotate anvil 72 about its torque axis 80 to thereby impart rotation to screw rod 50 about its rotational axis 52. As a consequence, jaws 18 and 20 are caused to vary the spacing 34 therebetween depending upon the direction of rotation of anvil 72. Torque driver 78 may be utilized to easily, and possibly rapidly and repeatedly, open and close jaws 18, 20 as desired and without resort to a conventional orthogonally positioned handle and the drawbacks thereof. It will be appreciated, however, that because jaw control is through face 75, and advantageously through aperture 74 extending along rotational axis 52, vise 10 may be mounted anywhere on surface 84 that is available and so need not necessarily be mounted at the edge (not shown) thereof. Moreover, substantial torque may be imparted to screw rod 50 via anvil 72 and control aperture 74 such that workpiece 40 may be tightly gripped without the need to resort to extensions or hammers, for example.

Figure 3C:
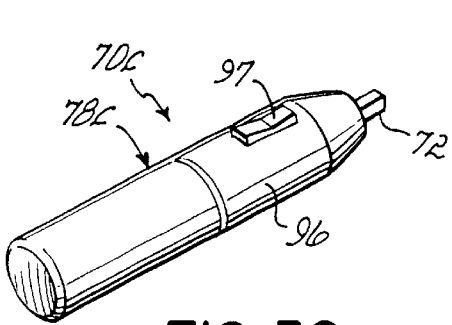
FIGS. 3A, 3B and 3C are perspective views of three exemplary drive mechanisms for use with the present invention.
Figure 3B:
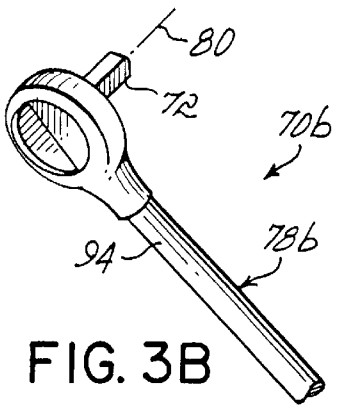
Figure 3A:
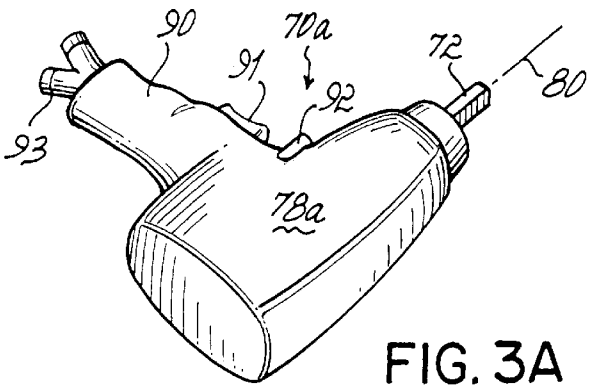

Various drive mechanisms 70 may be used, three of which will be described with reference to FIGS. 3A, 3B and 3C. Drive mechanism 70*a* of FIG. 3A includes a pneumatic impact wrench 78*a* as the torque driver. Wrench 78*a*, supports anvil 72 and has a handle 90 extending orthogonally to torque axis 80 for gripping by the user (not shown). Wrench 78*a* may be a conventional device having an actuating button 91 which is utilized to cause rotation of anvil 72 in a selected direction, and a switch 92 to select the direction of rotation thereof. A coupling 93 may also be provided at handle 90 for coupling to a pneumatic air source (not shown). With torque drive 78*a*, button 91 may be repeatedly actuated, with intervening state changes of switch 92, to rapidly and repeatedly open and close jaws 18, 20 as needed or desired. The speed or torque may also be varied by the user (not shown) as is conventional. An electric impact wrench may alternatively be used, an example of which is Craftsman Model No. 27513 sold by Sears as item #0092751300.

Drive mechanism 70*b* may include a socket or ratchet wrench 78*b*. Wrench 78*b* may have a handle 94 extending orthogonally to torque axis 80 to be gripped by the user (not shown). Wrench 78*b* may be a conventional, manually operated ratchet wrench such as for a socket set, or may be air driven via handle 94 (such as Craftsman ⅜ in. ratchet wrench Model No. 19992 sold by Sears as item #00919992000), or may be electrically powered from within handle 94. While handles 90 and 94 extend orthogonally relative to torque axis 80, other drive mechanisms may have a torque driver which extends coaxially or coincident with torque axis 80. By way of example, and with reference to FIG. 3C, drive mechanism 70*c* includes an electrically powered screw driver-like torque driver 78*c* which is defined by a gripping housing 96 extending along torque axis 80 and having one or more switches 97 by which to actuate mechanism 70*c* to rotate anvil 72 in the desired direction about torque axis 80. Alternatively, the torque drive 70*c* may appear like a manual screw driver with a handle at the proximal end extending along the torque axis, but with an anvil at its distal end (all not shown). The anvil 72 of each drive mechanism 70, 70*a*, 70*b* and/or 70*c* may conventionally be of square cross-section and of any standard size such as ¼", ⅜", ½", or ¾", or otherwise as is readily understood. Aperture 74 will be mutually sized and shaped and may also have a square cross-section or other cross-section that will receive and engage with anvil 72 as it is rotated. Thus, for a ½" square anvil 72, the aperture 74 may, for example, be square in cross-section with approximately ½" measured from opposite walls 77 thereof. Although not shown, a conventional extender bar or the like may be utilized to couple anvil 72 to aperture 74 or 74*a*, if desired, in which case for purposes of the present invention, the anvil is considered to have been received in the aperture.

In some situations, it may be desired to have more refined control over rotation of screw rod 50. For example, where workpiece 40 is a delicate item or there is a need to maintain fine adjusting control, use of anvil 72 and control aperture 74 may not be sufficient. In those situations, a manually operable handle 100 and/or 110 may additionally be provided. Handle 100, which is shown in dotted line in FIG. 1, may be integrally attached to hub 76 of accessible end 54 so as to project from the surface 102 thereof in a direction that is orthogonal to rotational axis 52. Handle 100 may thus be manually manipulated to rotate screw rod 50. With integral handle 100, it will be appreciated that accessible end 54 may be positioned to overlie work surface 84. Accordingly, it is necessary that handle 100 have a length L to its free end 104 from its axis 52 sufficiently large that it may be manipulated by the user (not shown), but not so long as to impact against surface 84 as rod 50 is rotated over a complete revolution, for example. To this end, length L is advantageously less than the spacing S between the rotational axis 52 of screw rod 50 and work surface 84 (i.e., the distance defined between the planar contact of bottom side 82 of base 12 and rotational axis 52). Although only one handle 100 is suggested in FIG. 1, it will be appreciated that a plurality of such handles spaced about accessible end 54 may be provided.

Additionally or alternatively, a moveable or slidable handle similar to the prior art conventional handles may be provided. To this end, accessible end 54 may include a handle-receiving hole 112 extending into and possibly through hub 76 of end 54 in a direction orthogonal to rotational axis 52. A handle 110 is provided which is sized to be received in hole 112. Handle 110 may project to one side therefrom, or may extend completely through hub 76 if hole 112 extends therethrough. Handle 110 is adapted to be slidably received in hole 112 such that it can slide back and forth therethrough and therefore provide control of jaws 18, 20 as would be done with a conventional handle (not shown).

Handle 110 may include an enlarged end 114 to be larger than the diameter of hole 112 so as to prevent handle 110 from sliding completely through hole 112. Handle 110 may further include a protrusion 116 which may be defined by a spring-loaded member such as a ball or detent 117 biased by spring 117*a* to project from the surface 118 of handle 110 to a distance sufficient to hold handle 110 within hole 112 under normal use. Protrusion 116 may be near one end 120 opposite from enlarged end 114. Spring-loaded member 117 will depress as it enters into hole 112 and then project back out to its original position after passing therethrough. Protrusion 116 thus provides an enlargement which extends beyond the diameter of hole 112 to thus hold handle 110 slidably within hole 112 until handle 110 is pulled therefrom with enough force to depress member 117 and allow handle 110 to exit hole 112.

Figure 4A:
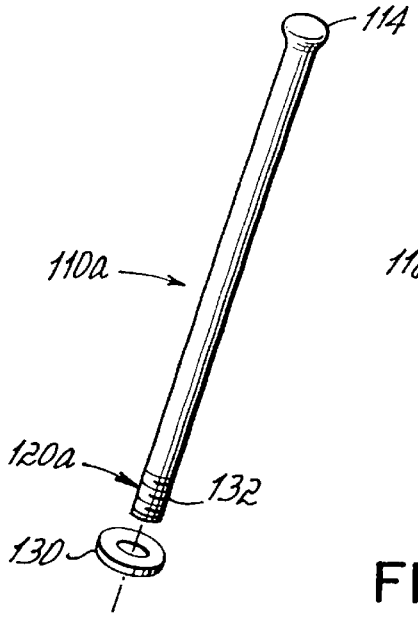
FIGS. 4A and 4B are perspective views of alternative handles useful with the vise of FIG. 1.
Figure 4B:
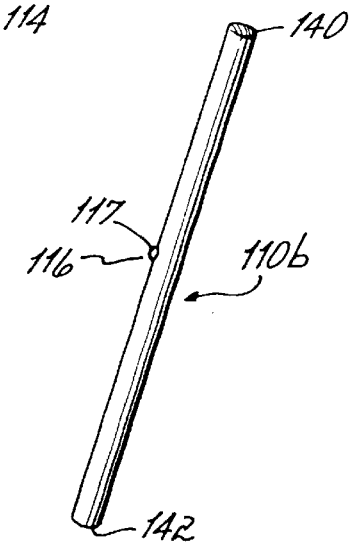

With reference to FIGS. 4A and 4B, exemplary alternatives to handle 110 are shown in the forms of handles 110*a* and 110*b*. Handle 110*a* includes enlarged end 114, but instead of a more or less permanent protrusion at the opposite end 120*a* thereof, a removable protrusion 130 is provided. Protrusion 130 is intended to be removably received on end 120*a*. In the embodiment shown in FIG. 4A, protrusion 130 is an internally threaded annular member or nut to cooperate with threads 132 formed on end 120*a* so as to allow protrusion 130 to be threadably placed onto and removed from end 120*a*. Protrusion 130 and end 120*a* could alternatively be sized and shaped to provide for a removable snap-fit therebetween.

A further alternative handle 110*b* shown in FIG. 4B includes protrusion 116 with spring-loaded member 117 located centrally of handle 110*b* between opposite ends 140, 142 so as to frictionally engage within hole 112 and hold handle 110*b* thereon. Hole 112 may further be provided with a recess (not shown) centrally thereof to receive protrusion 116 when handle 110 or handle 110*b* is inserted therein.

Handles 110, 110*a* and/or 110*b* may be longer between the ends than spacing S and so might impact surface 84 in use. Handles 110, 110*a*, 110*b* may thus be advantageously used for partial or fine adjustment control of jaws 18, 20, or may be used when accessible end 54 projects out over the end (not shown) of work surface 84. However, in those situations where handle 110, 110*a*, 110*b* will otherwise impact against surface 84 when anvil 72 is received in aperture 74 and rotated thereabout, handle 110, 110*a*, 110*b* may be removed if desired. However, handles 100 may remain due to their shorter size.

In the vise 10 described above, aperture 74, and, if provided, handle(s) 100 and/or hole 112 are integrally provided or formed on the hub 76 which defines the accessible end 54 of screw rod 50. Hub 76 could actually be formed as part of screw rod 50 or may be fixedly, and generally permanently attached thereto by any conventional means including, by way of example, welding. While hub 76 defining accessible end 54 is typically larger in diameter than the rest of screw rod 50, it need not be so and could, instead, simply be seen as an extension of screw rod 50. In any event, aperture 74 and possibly handle(s) 100 and/or hole 112, are thus supported or located directly on accessible end 54.

In some situations, it may be advantageous to selectively or removably support at least aperture 74 on the accessible end of the screw rod. To this end, and with reference to FIG. 5, the accessible end 254 of screw rod 256 may have a surface 258 which is pre-shaped to operatively and removably receive a crank handle (not shown) thereover, such as in the case of a mechanics vise. The jaw control of the present invention may be readily applied on a selective basis to such an accessible end 254. To that end, a removable hub or fitting 260 is provided which includes a slot-opening 262 at distal face 264 sized and shaped to removably receive therein in mating relationship preformed surface 258. The control aperture 74 may be provided at the proximal face 266 of fitting 260 so as to be at accessible end 254, and extend along the longitudinal axis 270 of screw rod 256, when fitting 260 is attached to accessible end 256. Fitting 260 may additionally include handle(s) 100 and/or hole 112, although one or both could also be provided directly on accessible end 254 such that aperture 74 is alone supported on and carried by fitting 260 so as to be indirectly located at the accessible end 254 of the screw rod.

Figure 5:
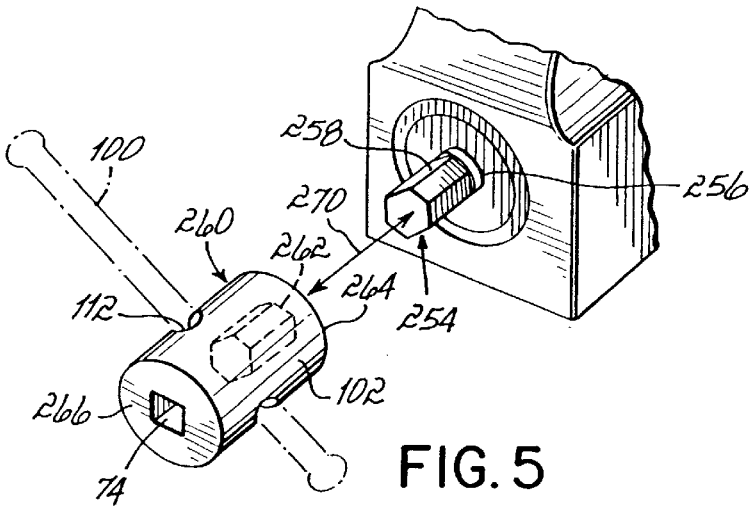
FIG. 5 is a partial perspective view of an alternative embodiment of a jaw control in accordance with the principles of the present invention.

In use of the fitting 260 of FIG. 5, fitting 260 is mounted to accessible end 254, and anvil 72 is inserted into aperture 74 (either before or after mounting of fitting 260 to accessible end 254). Torque driver 78 of drive mechanism 70 is then operated to rotate screw rod 256 in the same manner as described with respect to rotation of screw rod 50 of vise 10.

Figure 6A:
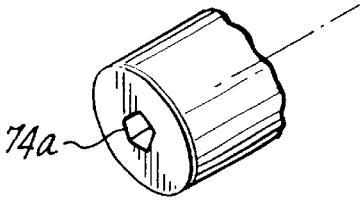
FIGS. 6A and 6B are partial, perspective views of two exemplary alternative jaw control embodiments.
Figure 6B:
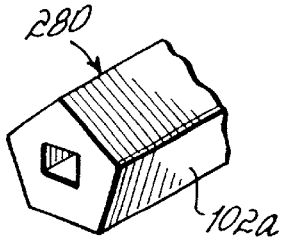

While anvil 72 and control aperture 74 are shown as having a square cross-section, it is possible that aperture 74 could take on different shapes. For example, as shown in FIG. 6A, aperture 74*a* could be shaped like a pentagon to receive anvil 72 or some other shaped anvil (not shown) as might be provided by drive mechanism 70. Additionally, or alternatively, the exterior surface 102 of accessible end 54 (FIG. 1) or surface 102*a* of fitting 260 (FIG. 4) could further be formed as at 280 (FIG. 6B) to have a shape like that of accessible end 254 (FIG. 5), whereby to be adapted to also receive a conventional mechanics vise crank handle or a conventional socket thereover.

Figure 7:
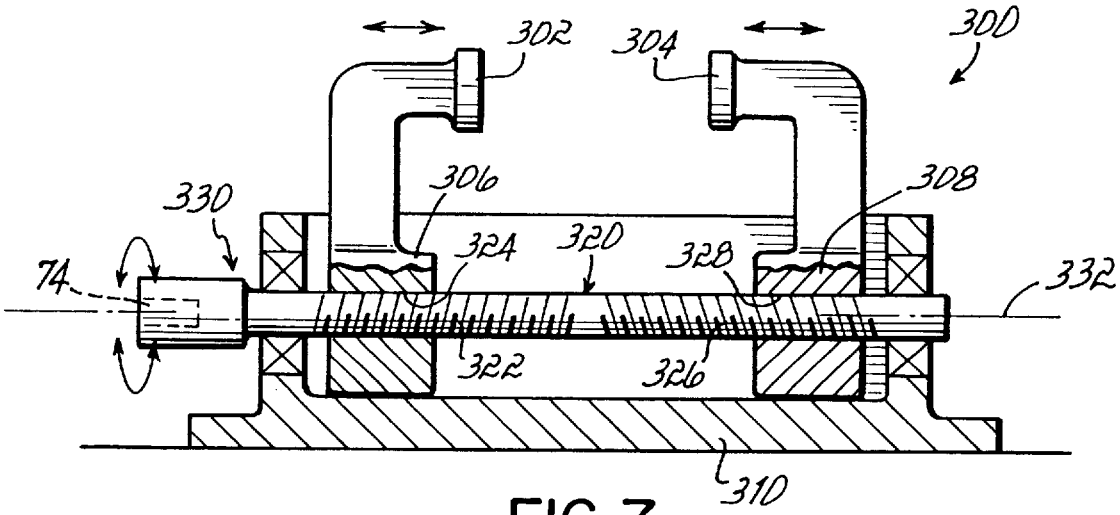
FIG. 7 is a cross-sectional view of a second exemplary vise incorporating a jaw control in accordance with the principles of the present invention.

A further exemplary vise 300 shown in FIG. 7 includes a pair of jaws 302, 304 movably supported by respective jaw feet 306, 308 on a base 310. Vise 300 includes a screw rod 320 operatively associated with both jaws 302, 304. To this end, first threads 322 of rod 320 threadably engage internally threaded bore 324 of foot 306, and oppositely directed, second threads 326 of rod 320 threadably engage internally threaded bore 328 of foot 308. Thus, upon rotation of screw rod 320 clockwise, there will be relative motion of both jaws 302, 304 toward each other, as well as absolute motion of both jaws 302, 304 relative to base 310. Rotation of screw rod 320 counterclockwise will cause relative motion of both jaws 302, 304 away from each other, as well as absolute motion of both jaws 302, 304 relative to base 310. To control such movement, a control aperture 74 or a variant thereof may be located at accessible end 330 of screw rod 320, either directly as in FIG. 1 or indirectly as in FIG. 5. Anvil 72 may then be coupled to aperture 74 to cause rotation of screw rod 320 about its rotational axis 332 by rotation of anvil 72 about its torque axis 80. Vise 300 may also be provided with a handle(s) 100 and/or handle-receiving hole 112 as above-described with reference to vise 10.

Figure 8:
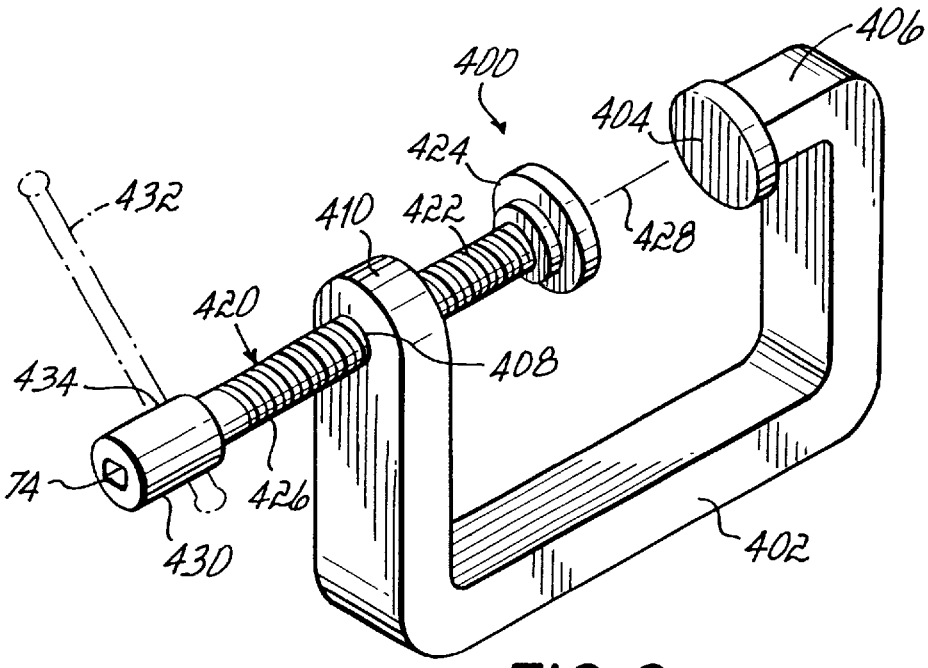
FIG. 8 is a perspective view of a third exemplary vise, in the form of a C-clamp, incorporating a jaw control in accordance with the principles of the present invention.

A yet further exemplary vise in the form of a C-clamp 400 is shown in FIG. 8. Vise 400 includes a C-shaped support 402 carrying a fixed integral jaw 404 on one end 406 thereof, and a threaded slot 408 at the other end thereof. Vise 400 also includes a threaded screw rod 420. Mounted at distal end 422 of rod 420 is a second jaw 424 confronting fixed jaw 404. The threads 426 of rod 420 engage slot 408 to move rod 420, and thus jaw 424, back and forth relative to jaw 404 as rod 420 rotates about its rotational axis 428. The accessible or proximal end 430 of rod 420 includes, directly or indirectly, control aperture 74 by which to control rotation of screw rod 420 by anvil 72 as described in connection with the other exemplary embodiments above, and may further include a handle 432 (shown in phantom line in FIG. 8) slidably received in handle-receiving hole 434 at accessible end 430.

By virtue of the foregoing, there is thus provided a jaw control for a vise which reduces or eliminates the problems associated with conventional vises which provide jaw control by a handle slidably received in the hub.

While the present invention has been illustrated by the description of various embodiments thereof, and while the embodiments have been described in considerable detail, it is not intended to restrict or in any way limit the scope of the appended claims to such detail. Additional advantages and modifications will readily appear to those skilled in the art. For example, while control of the jaws is via an aperture at the proximal end face of the accessible end, control may be obtained by otherwise attaching a drive mechanism at or to that face. Also, while two shapes of control aperture 74, 74*a* are shown, the control aperture could have a different configuration, such as a hexagonal or star shape in cross-section, for example. And, while the control apertures are shown to extend along, and also coaxial with, the rotational axis of the screw rod, the control aperture could be defined by one or more openings into the accessible end or fitting therefor, and which are either offset from or spaced away from the rotational axis but otherwise still extend therealong. In addition, various vise constructions are shown herein by way of example, and not limitation, it being understood that the control aperture concept of the present invention is applicable to a variety of vise constructions. As a further example, a vise similar to vise 10 could be provided but without rotatable support 14, such that jaw 20 is fixedly mounted directly to base 12. Further, the base of the vise may be held to work surface 84 such as by clamping, suction, or the application of magnetic force. The base might even be configured such that it is not required to be mounted to a surface 84 at all. Still further, the vise could be mounted to a work vehicle to provide advantages in that environment as well. Moreover, a vise having various, or interchanged, aspects of the vises shown herein may be provided with the control aperture of the present invention. The invention in its broader aspects is therefore not limited to specific details, representative apparatus, and methods and illustrative examples shown and described. Accordingly, departures may be made from such details without departing from the scope or spirit of applicant's general inventive concept.

Having described the invention, what is claimed is:

1. A vise comprising:

a base having a bottom adapted to rest independently and stably on a flat surface;

a pair of jaws supported on the base and being moveable relative to one another to vary spacing therebetween whereby to selectively grip a workpiece between the jaws;

a screw rod operably associated with at least one of the jaws and being rotatable about a rotational axis being spaced a distance from the bottom of the base such that rotation of the screw rod about the rotational axis causes relative motion between the jaws;

a handle-receiving hole associated with the accessible end of the screw rod and extending substantially orthogonal to the rotational axis of the screw rod, the handle-receiving hole sized and shaped to receive a handle therein;

a manual handle selectively removably and slidably received in the handle-receiving hole and having a length greater than the distance between the rotational axis and the bottom of the base, the manual handle being adapted to permit selective removal of the handle from and re-attachment of the handle through the handle-receiving hole; and a control aperture located at an accessible end of the screw rod and extending along the rotational axis of the screw rod, the aperture being sized and shaped to removably receive a projecting and rotatable anvil of a driving mechanism inserted into the aperture along the rotational axis, whereby rotation of said anvil completely about a torque axis of said driving mechanism imparts rotational motion to the screw rod completely about the rotational axis thereby adjusting the spacing between the jaws.

2. The vise of claim 1, one of the jaws being fixedly supported relative to the base and another of the jaws being movably supported thereon.

3. The vise of claim 1 further comprising a support rotatably mounted to the base and supporting the jaws.

4. The vise of claim 3, one of the jaws being fixedly mounted on the support and another of the jaws being movably mounted on the support.

5. The vise of claim 1, the jaws being movably supported on the base, the screw rod being operably associated with each of the jaws whereby rotation of the screw rod about the rotational axis causes each of the jaws to move relative to the base.

6. The vise of claim 1 further comprising a protrusion on the handle sized to retain the handle in the handle-receiving hole.

7. The vise of claim 6, the protrusion including a spring-loaded member.

8. The vise of claim 6, the protrusion being at an end of the handle.

9. The vise of claim 6, the protrusion being centrally located on the handle.

10. The vise of claim 6, the protrusion being selectively removably attached to the handle.

11. The vise of claim 1 further comprising a formed outer surface at the accessible end of the screw rod, the formed outer surface being sized and shaped to receive a socket.

12. The vise of claim 1 further comprising a fitting removably attachable to the accessible end of the screw rod, the aperture being supported by the removable fitting.

13. The vise of claim 12, wherein said handle-receiving hole is in the removable fitting proximate the aperture and substantially orthogonal to the aperture.

14. The vise of claim 1, the aperture having a generally square cross-section.

15. In combination, a vise and a drive mechanism, the vise including:

a pair of jaws being moveable relative to one another to vary spacing therebetween whereby to selectively grip a workpiece therebetween;

a screw rod operably associated with at least one of the jaws and being rotatable about a rotational axis such that rotation of the screw rod about the rotational axis causes relative motion between the jaws;

a control aperture located at an accessible end of the screw rod and extending along the rotational axis of the screw rod; and a handle associated with the accessible end of the screw rod and extending substantially orthogonal to the rotational axis of the screw rod, the handle being received in a hole extending substantially orthogonal to the rotational axis of the screw rod;

the drive mechanism including:

a pneumatic impact wrench having a projecting and rotatable anvil, the anvil being rotatable about a torque axis of the pneumatic impact wrench;

the control aperture of the vise and the anvil of the pneumatic impact wrench being mutually sized and shaped to be selectively received together, the anvil being removably inserted into the aperture along the rotational axis with the torque axis of the pneumatic impact wrench and the rotational axis of the screw rod being substantially aligned, whereby rotation of the anvil about the torque axis imparts rotational motion to the screw rod about the rotational axis thereby adjusting the spacing between the jaws.

16. In combination, a vise and a drive mechanism, the vise including:

a pair of jaws being moveable relative to one another to vary spacing therebetween whereby to selectively grip a workpiece therebetween;

a screw rod operably associated with at least one of the jaws and being rotatable about a rotational axis such that rotation of the screw rod about the rotational axis causes relative motion between the jaws;

a control aperture located at an accessible end of the screw rod and extending along the rotational axis of the screw rod; and a handle-receiving hole associated with the accessible end of the screw rod and extending substantially orthogonal to the rotational axis of the screw rod, the handle-receiving hole sized and shaped to receive a handle therein;

the drive mechanism including:

a pneumatic impact wrench having a projecting and rotatable anvil, the anvil being rotatable about a torque axis of the pneumatic impact wrench;

the control aperture of the vise and the anvil of the pneumatic impact wrench being mutually sized and shaped to be selectively received together, the anvil being removably inserted into the aperture along the rotational axis with the torque axis of the pneumatic impact wrench and the rotational axis of the screw rod being substantially aligned, whereby rotation of the anvil about the torque axis imparts rotational motion to the screw rod about the rotational axis thereby adjusting the spacing between the jaws.

17. A method of controlling spacing between relatively movable jaws of a vise, the vise having a rotatable screw rod operably associated with at least one of the jaws such that rotation of the screw rod about a rotational axis causes relative movement between the jaws to vary the spacing therebetween, the screw rod having a control aperture extending along the rotational axis and sized and shaped to receive a projecting and rotatable anvil of a drive mechanism therein for causing rotation of the screw rod, the screw rod further having a handle-receiving hole orthogonal to the rotational axis with a manual handle extending therethrough, the method comprising:

removing the manual handle from the handle-receiving hole;

inserting an anvil of a driving mechanism into the control aperture along the rotational axis; and after such removal of the manual handle and insertion of the anvil, causing the screw rod to rotate about its rotational axis by operation of the driving mechanism so as to cause relative movement between the jaws whereby to control spacing between the jaws.

18. The method of claim 17 further comprising causing the screw rod to rotate completely about is rotational axis by operation of the driving mechanism.

* * * * *